United States Patent [19]

Osawa et al.

[11] Patent Number: 4,906,544

[45] Date of Patent: Mar. 6, 1990

[54] PHOTOSENSITIVE MEMBER OF PLASMA POLYMERIZED AMORPHOUS CARBON CHARGE TRANSPORTING LAYER AND CHARGE GENERATING LAYER

[75] Inventors: Izumi Osawa, Ikeda; Shuji Iino, Hirakata; Hideo Hotomi, Suita; Mitsutoshi Nakamura, Osaka, all of Japan

[73] Assignee: Minolta Camera Kabushiki Kaisha, Osaka, Japan

[21] Appl. No.: 395,188

[22] Filed: Aug. 18, 1989

Related U.S. Application Data

[63] Continuation of Ser. No. 254,728, Oct. 7, 1988, which is a continuation of Ser. No. 27,866, Mar. 19, 1987.

[30] Foreign Application Priority Data

Mar. 20, 1986 [JP] Japan ..... 61-63743
Mar. 20, 1986 [JP] Japan ..... 61-63744

[51] Int. Cl.[4] ..... G03G 5/14

[52] U.S. Cl. ..... 430/58; 435/60; 435/66

[58] Field of Search ..... 430/58, 60, 66

[56] References Cited

U.S. PATENT DOCUMENTS

| | | | |
|---|---|---|---|
| 3,189,447 | 6/1965 | Neugebauer et al. . | |
| 3,820,989 | 6/1974 | Rule et al. . | |
| 3,956,525 | 5/1976 | Yasuba | 427/41 |
| 4,366,208 | 12/1982 | Akai et al. | 428/421 |
| 4,376,688 | 3/1983 | Ceasar et al. | 204/192 |
| 4,416,755 | 11/1983 | Caesar et al. | 204/192 |
| 4,495,262 | 1/1985 | Matsuzaki et al. | 430/58 |
| 4,510,224 | 4/1985 | Yamazaki et al. | 430/5 |
| 4,518,670 | 5/1985 | Matsuzaki et al. | 430/58 |
| 4,544,617 | 10/1985 | Mort et al. | 430/58 |
| 4,557,987 | 12/1985 | Shirai et al. | 430/58 |
| 4,559,289 | 12/1985 | Sunagawa et al. | 430/66 |
| 4,579,801 | 4/1986 | Yashiki | 430/60 |
| 4,634,648 | 1/1987 | Jansen et al. | 430/84 |
| 4,675,265 | 6/1987 | Kazama et al. | 430/66 X |
| 4,738,912 | 4/1988 | Iino et al. | 430/58 |
| 4,741,982 | 5/1988 | Iino et al. | 430/58 |
| 4,743,522 | 5/1988 | Iino et al. | 430/58 |
| 4,749,636 | 6/1988 | Iino et al. | 430/58 |
| 4,755,444 | 7/1988 | Karakida et al. | 430/66 |
| 4,797,338 | 1/1989 | Iino et al. | 430/58 |
| 4,810,606 | 3/1989 | Iino et al. | 430/58 |

FOREIGN PATENT DOCUMENTS

| | | | |
|---|---|---|---|
| 50-30526 | 3/1975 | Japan . | |
| 54-115134 | 9/1979 | Japan . | |
| 56-62254 | 5/1981 | Japan . | |
| 56-60447 | 9/1981 | Japan . | |
| 57-114146 | 7/1982 | Japan | 430/66 |
| 60-63541 | 3/1985 | Japan . | |
| 60-67955 | 4/1985 | Japan | 430/66 |
| 60-249155 | 12/1985 | Japan . | |
| 61-94056 | 5/1986 | Japan . | |
| 1174171 | 12/1969 | United Kingdom . | |

OTHER PUBLICATIONS

"Properties of Diamond—Like Carbon Films", *Thin Solid Films*, vol. 119, pp. 121–126, 1984.

"Electronic Properties of Substitutionally Doped Amorphous Si and Ge", *Philisophical Magazine*, vol. 33, No. 6, pp. 935–949, 1976.

"Photosensitive Materials for Electron Photography—OPC vs. Inorganics", *Nikkei New Materials*, Dec. 15, 1986.

Journal of Applied Polymer Science, vol. 17, 1973.

"A Review of Recent Advances in Plasma Engineering", *Review of Recent Advances*, Mar. 29, 1979.

"A C—NMR Investigation of Plasma Polymerized Ethane, Ethylene, and Acetylene", by A. Dilks, S. Kaplan, and A. Vanlaeken, Xerox Webster Research Center, Xerox Square, W-114, Rochester, N.Y. 14644.

*Primary Examiner*—Roland E. Martin

*Attorney, Agent, or Firm*—Burns, Doane, Swecker & Mathis

[57] ABSTRACT

The practice of this invention provides a photosensitive member which comprises a charge generating layer, and a plasma-polymerized layer, wherein said plasma-polymerized layer having an infrared absorption spectrum of a ratio of coefficients of absorptivities attributed to methyl group (—$CH_3$) to those of methylene group (—$CH_2$—), and is a coefficient of absorptivity attributed to methylene group (—$CH_2$—) at about 2925 $cm^{-1}$. The photosensitive member obtained thereby is excellent in charge-transporting property and chargeability and, moreover, exhibits advantages in corona resistance and resistances to acids, moisture and heat and also in physical properties such as stiffness.

11 Claims, 5 Drawing Sheets

PHOTOSENSITIVE MEMBER OF PLASMA POLYMERIZED AMORPHOUS CARBON CHARGE TRANSPORTING LAYER AND CHARGE GENERATING LAYER

This application is a continuation of application Ser. No. 254,728 filed Oct. 7, 1988 which is a continuation of application Ser. No. 027,866 filed Mar. 19, 1987.

BACKGROUND OF THE INVENTION

This invention relates to a photosensitive member and, more particularly, to a photosensitive member in electrophotography.

Since the invention of Carlson's method (U.S. Pat. No. 222,176, 1938), electrophotography has been making remarkable progress in applicability and commercial introduction and there have since been various materials developed and introduced as photosensitive members in electrophotography.

The photosensitive materials which have found use mainly in electrophotography are: in the area of inorganic substances, amorphous selenium, arsenic selenide, tellurium selenide, cadmium sulfide, zinc oxide, amorphous silicon, etc., and in the area of organic substances, polyvinyl carbazole, metallic phthalocyanine, disazo pigments, trisazo pigments, perylene pigments, triphenylmethane compounds, triphenylamine compounds, hydrazone compounds, styryl compounds, pyrazoline compounds, oxazole compounds, oxadiazole compounds, etc.

These photosensitive materials have constituted the required photosensitive members, some forming monolayers of simple substances, some dispersed in some binding agent forming dispersions in binders, and others in the form of laminates, each functionally composed of a charge generating layer and a charge transporting layer.

Such photosensitive materials, however, have exhibited defects when used in electrophotography in the past.

One of the defects has been a harmfulness to human health: with the exception of amorphous silicon, all the inorganic substances referred to above have properties detrimental to human health.

On the other hand, a photosensitive member in practical use in a copying machine is required always to be stable in properties to rigorous conditions and environmental problems, such as those concerning electrostatic charging, exposure to light, development, transferring, static elimination, and cleaning. In this respect, all the organic substances enumerated above are lacking in durability and, when used, instability has come to the fore in many points of the useful properties.

As a means to solve the above-mentioned problems, amorphous silicon (hereinafter abbreviated to "a-Si"), made by the plasma chemical vapor deposition process (hereinafter called "plasma CVD process"), has in recent years been finding application as a photosensitive material, especially in electrophotography.

The photosensitive material a-Si has various splendid properties. However, its use raises a problem that, because of a large specific inductive capacity epsilon approximately 12, a-Si essentially needs to form a film with a minimum thickness of approximately 25 microns in order for the photosensitive member to have a sufficient surface potential.

The production of a-Si photosensitive members by the plasma CVD process is a time-consuming operation with the a-Sifilm formed at a slow rate of deposition, and, moreover, the more difficult it becomes to obtain s-Si films of uniform quality, the longer it takes for the films to be formed. Consequently, there is a high probability that an a-Si photosensitive member in the use causes defects in images, such as white spot noise, besides other defects including an increase in cost of the raw material.

In any attempt for improvement that has been made concerning the above-mentioned defects, it was essentially undesirable to make the film thickness smaller than the minimum mentioned above.

Furthermore, the a-Si photosensitive material exhibits defects in adhesivity to the substrate, in corona resistance and resistance to environment and also chemicals.

As an answer to the problems described above, it has been proposed to provide an a-Si photosensitive layer with an overcoating layer or an undercoating layer of an organic plasmapolymerized film: examples describing the overcoating were announced in Japanese Patent KOKAI Nos. 61761/1985, 214859/1984, 46130/1976, U.S. Pat. No. 3,956,525, etc. and those describing the undercoating in Japanese Patent KOKAI Nos. 63541/1985, 136742/1984, 38753/1984, 28161/1984, 60447/1981, etc.

It is known that an organic plasma-polymerized film can be made from any of gaseous organic compounds, such as ethylene gas, benzene and aromatic silane, (one reference in this respect is the Journal of Applied Polymer Science, 1973, 17 (885–892) contributed by A.T. Bell, M. Shen et al.), but any such organic plasma-polymerized film produced by a conventional method has been in use only where its insulation property is required to be good. Films of this kind have been regarded as insulators having electrical resistance of approximately $10^{16}$ohm cm, such as an ordinary polyethylene film, or at the least as materials practically similar to an insulator in the application.

The Japanese Patent KOKAI No. 61761/1985 made public a photosensitive member coated with a surface protective layer which is a carbon insulation film resembling diamond with a film thickness of 500 angstrom–2 microns. This thin carbon film is designed to improve a-Si photosensitive members with respect to their resistance to corona discharge and mechanical strength. The polymer film is very thin and an electric charge passes within the film by a tunnel effect, the film itself not needing an ability to transport an electric charge. The publication lacked a description relating to the carrier-transporting property of the organic plasma-polymerized film and the topic matter failed to provide a solution to the essential problems of a-Si in the foregoing description.

The Japanese Patent KOKAI No. 214859/1984 made public the use of an overcoating layer of an organic transparent film with thickness of approximately 5 microns which can be made from an organic hydrocarbon monomer, such as ethylene and acetylene, by a technique of plasma polymerization. The layer described therein was designed to improve a-Si photosensitive members with respect to separation of the film from the substrate, durability, pinholes, and production efficiency. The publication lacked a description relating to the carrier-transporting property of the organic plasma-polymerized film and the topic matter failed to provide a solution to the essential problems of a-Si in the foregoing description.

The Japanese Patent KOKAI No. 46130/1976 made public a photosensitive member utilizing n-vinylcarbazole, wherein an organic plasma-polymerized film with thickness of 3 microns–0.001 microns was formed at the surface by a technique of glow discharge. The purpose of this technique was to make bipolar charging applicable to a photosensitive member of poly-n-vinylcarbazole, to which otherwise only positive charging had been applicable. The plasma-polymerized film is produced in a very thin layer of 0.001 microns—3 microns and used by way of overcoating. The polymer layer is very thin, and it is not considered necessary for it to have an ability for the transportation of an electric charge. The publication lacked a description relating to the carrier transporting property of the polymer layer and the topic matter failed to provide a solution to the essential problems of a-Si in the foregoing description.

The U.S. Pat. No. 3,956,525 made public a technique whereby on a substrate a layer of a sensitizer is laid and thereupon a layer of an organic photoconductive electric insulator is superimposed and the laminate is overlaid by a polymer film 0.1 micron –1 micron thick formed by a technique of glow discharge. This film is designed to protect the surface so as to make the photosensitive members resistant to wet developing and therefore used by way of overcoating. The polymer film is very thin and does not need an ability to transport an electric charge. The publication lacked a description relating to the carrier transporting property of the polymer film and the topic matter failed to provide a solution to the essential problems of a-Si in the foregoing description.

The Japanese Patent KOKAI No. 63541/1985 made public a photosensitive member wherein an a-Si layer is undercoated by an organic plasma-polymerized film resembling diamond with a thickness of 200 angstrom 2 microns. The organic plasma-polymerized film is designed to improve the adhesivity of the a-Si layer to the substrate. The polymer film can be made very thin and an electric charge passes within the film by a tunnel effect, the film itself not needing an ability to transport an electric charge. The publication lacked a description relating to the carrier transporting property of the organic plasma-polymerized film and the topic matter failed to provide a solution to the essential problems of a-Si in the foregoing description.

The Japanese Patent KOKAI No. 28161/1984 made public a photosensitive member wherein on a substrate an a-Si film is laid and thereupon an organic plasma-polymerized film is superimposed. The organic plasma-polymerized film is used as an undercoat, the insulation property thereby being utilized, and also has the functions of blocking, improving the adhesivity, or preventing the separation of the photosensitive coat. The polymer film can be made very thin and an electric charge passes within the film by a tunnel effect, the film itself not needing an ability to transport an electric charge. The publication lacked a description relating to the carrier transporting property of the organic plasma polymerized film and the topic matter failed to provide a solution to the essential problems of a-Si in the foregoing description.

The Japanese Patent KOKAI No. 38753/1984 made public a technique whereby an organic plasma polymerized thin film with a thickness of 10–100 angstrom is formed from a mixed gas composed of oxygen, nitrogen and a hydrocarbon, by a technique of plasma polymerization and thereupon an a-Si layer is formed. Said organic plasma-polymerized film is used as an undercoat utilizing the insulation property of the polymer and also has the functions of blocking or preventing the separation of the photosensitive coat. The polymer film can be made very thin and an electric charge passes within the film by a tunnel effect, the film itself not needing an ability to transport an electric charge. The publication lacked a description relating to the carrier transporting property of the organic plasma-polymerized film and the topic matter failed to provide a solution to the essential problems of a-Si in the foregoing description.

The Japanese Patent KOKAI No. 136742/1984 described a semiconductor device wherein on a substrate an organic plasma-polymerized layer with thickness of approximately 5 microns was formed and thereon a silicon layer was superimposed. Said organic plasma-polymerized layer was designed to prevent the aluminum, the material forming the substrate, from diffusing into the a-Si, but the publication lacked description relating to the method of its fabrication, its quality, etc. The publication also lacked a description relating to the carrier transporting property of the organic plasma-polymerized layer and the topic matter failed to provide a solution to the essential problems of a-Si in the foregoing description.

The Japanese Patent KOKAI No. 60447/1981 made public a method of forming an organic photoconductive layer by plasma polymerization. The publication lacked description relating to the applicability of the invention to electrophotography. The description in the publication dealt with said layer as a charge generating layer or a photoconductive layer and the invention described thereby differs from the present invention. The topic matter failed to provide a solution to the essential problems of a-Si in the foregoing description.

SUMMARY OF THE INVENTION

The primary object of this invention is to provide a photosensitive member which is free from the above-mentioned defects, good in electric charge-transporting properties and electrical chargeability, and ensures formation of satisfactory images.

Another object of this invention is to provide a photosensitive member which is capable of assuming a sufficient surface potential even when the thickness of the layer is small.

Another object of this invention is to provide a photosensitive member which can be fabricated at low cost and in a short time.

Another object of this invention is to provide a photosensitive member which has a plasma-polymerized layer which is good in resistances to corona discharge, acids, humidity and heat, and in stiffness.

These objects and other related objects can be accomplished by providing a photosensitive member which comprises an electrically conductive substrate, a charge generating layer, and a plasma-polymerized layer having a specific ratio of coefficient of absorptivity at 1460 $cm^{-1}$, 1470 $cm^{-1}$, 1380 $cm^{-1}$, 2960 $cm^{-1}$ and 2925 $cm^{-1}$ in an infrared absorption spectrum.

DETAILED DESCRIPTION OF THE INVENTION

Figure 1:
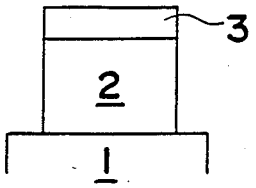
FIGS. 1 through 12 illustrate photosensitive members embodying the present invention in schematic cross sectional representation.

The first embodiment of the present invention is a photosensitive member comprising:

an electrically conductive substrate;

a charge generating layer; and a plasma-polymerized layer of amorphous material comprising hydrogen and carbon, wherein the infrared absorption spectrum of said plasma-polymerized layer has a ratio ($\alpha_1/\alpha_2$) of from 0.5 to 5.0, wherein $\alpha_1$ is a coefficient of peak absorptivity attributed to methyl group (—$CH_3$) and/or methylene group (—$CH_2$—) at about 1460 $cm^{-1}$ and about 1470 $cm^{-1}$ and $\alpha_2$ is a coefficient of peak abosrptivity attributed to methyl group (—$CH_3$) at about 1380 $cm^{-1}$; and the second embodiment of the present invention is a photosensitive member comprising:

an electrically conductive substrate;

a charge generating layer; and a plasma-polymerized layer of an amorphous material comprising hydrogen and carbon, wherein the infrared absorption spectrum of said plasma-polymerized layer has a ratio ($\alpha_3/\alpha_4$) of from 0.5 to 1.5, wherein $\alpha_3$ is a coefficient of peak absorptivity attributed to methyl group (—$CH_3$) at about 2960 $cm^{-1}$, and $\alpha_4$ is a coefficient of absorptivity attributed to methylene group (—$CH_2$—) at about 2925 $cm^{-1}$.

As the plasma-polymerized layer of the present invention has a charge transportability, in typical embodiments of the present invention the plasma-polymerized layer is applied to a charge transporting layer for a photosensitive member.

The coefficient of absorption ($\alpha$) of an infrared spectrum according to the present invention can be obtained from the transmittance and the thickness of the plasma polymerized layer of an amorphous material (referred to as an a-C layer hereinafter) according to the following equation:

$$\alpha = \frac{1}{d} \log_e \left( \frac{T}{T_0} \right)$$

wherein ($\alpha$) is a coefficient of absorption, (d) is a thickness, and $T/T_0$ is a transmittance.

In the first embodiment of the present invention a-C layer has a ratio of ($\alpha_1/\alpha_2$) is 0.5 to 5.0 wherein represents the coefficient of peak absorptivity attributed to methyl group and/or methylene group at about 1460 $cm^{-1}$ and about 1470 $cm^{-1}$, and is a coefficient of peak absorptivity attributed to methyl group at about 1380 $cm^{-1}$. More preferable ratio of ($\alpha_1/\alpha_2$) is 0.7 to 3.5, especially 0.9 to 2.5. An a-C layer having the ratio ($\alpha_1/\alpha_2$) of more than 5.0 cannot give a sufficient transportability, so that it cannot be used for an electrophotosensitive member for an electrophotography, whereas a-C layer having ratio ($\alpha_1/\alpha_2$) of less than 0.5 is too worse in the chargeability, properties, and producibility of layer.

In the first embodiment when the ratio ($\alpha_1/\alpha_2$) is not more than 5.0, the specific resistance of the a-C layer becomes less than about $10^{11}$ ohm.cm and the carrier mobility becomes more than about $10^{-7}$ $cm^2$ (V sec).

In the a-C layer of the present invention there are various kinds of group attributed to carbon atoms such as methyl, methylene or methine group, or various kinds of bonds between carbon atoms such as a single bond, double bond and triple bond, but in any cases it is important that the ratio ($\alpha_1/\alpha_2$) is within 0.5 to 5.0.

In the second embodiment in the infrared absorption spectrum of said plasma-polymerized layer a ratio ($\alpha_3/\alpha_4$) is from 0.5 to 1.5, wherein $\alpha_3$ is a coefficient of absorptivity attributed to methyl group (—$CH_3$) at about 2960 $cm^{-1}$, and $\alpha_4$ is a coefficient of absorptivity attributed to methylene group (—$CH_2$—) at about 2925 $cm^{-1}$. The ratio of ($\alpha_3/\alpha_4$) is more preferably 0.7 to 1.3, and most preferably 0.8 to 1.2. An a-C layer having the ratio ($\alpha_3/\alpha_4$) of less than 0.5 cannot give a sufficient transportability, so that it cannot be used for an electrophotosensitive member for an electrophotography, whereas a-C layer having the ratio ($\alpha_3/\alpha_4$) of more than 1.5 is too worse in the chargeability, properties, and producibility of layer.

In the second embodiment when the ratio of ($\alpha_3/\alpha_4$) is more than 0.5, the specific resistance of the a-C layer becomes less than about $10^{11}$ ohm.cm and the carrier mobility becomes more than about $10^{-7}$ $cm^2$ (V sec).

The thickness suitable for an a-C layer ranges 5–50 microns, the preferable range being 7–20 microns. The surface potential is lower and the images can not be copied in a sufficient density if the thickness is below 5 microns, whereas the productivity is impaired if the thickness exceeds 50 microns. An a-C layer exhibits good transparency and a relatively high dark resistance, and has such a good charge transporting property that, even when the layer thickness exceeds 5 microns as described above, it transports the carrier without causing a charge trap.

To form an a-C layer, an organic gas, a hydrocarbon, is preferably used. Such a hydrocarbon is not necessarily of a vapor phase at normal temperatures and normal pressure. It is practical as well to employ a hydrocarbon which, whether normally in the liquid phase or in the solid phase, can be vaporized through melting, vaporization, sublimation, or the like when heated, subjected to pressure reduction, or the like.

A hydrocarbon for this purpose can be selected from among, for example, methane series hydrocarbons, ethylene series hydrocarbons, acetylene series hydrocarbons, alicyclic hydrocarbons, aromatic hydrocarbons, etc. Further, these hydrocarbons can be mixed.

Examples of the methane series hydrocarbons applicable in this respect are:

normal—paraffins—methane, ethane, propane, butane, pentane, hexane, heptane, octane, nonan. decane, undecane, dodecane, tridecane, tetradecane, pentadecane, hexadecane, heptadecane, octadecane, nonadecane, eicosane, heneicosane, docosane, tricosane, tetracosane, pentacosane, hexacosane, heptacosane, octacosane, nonacosane, triacontane, dotriacontane, pentatriacontane, etc.; and isoparaffins—isobutane, isopentane, neopentane, isohexane, neohexane, 2,3-dimethylbutane, 2-methylhexane, 3-ethylpentane, 2,2-dimethylpentane, 2,4-dimethylpentane, 3,3-dimethylpentane, triptane, 2-methylheptane, 3-methylheptane, 2,2-dimethylhexane, 2,2,5-dimethylhexane, 2,2,3-trimethylpentane, 2,2,4-trimethylpentane, 2,3,3-trimethylpentane, 2,3,4-trimethylpentane, isononane, etc.

Examples of the ethylene series hydrocarbons applicable in this respect are:

olefins—ethylene, propylene, isobutylene, 1-butene, 2-butene, 1-pentene, 2-pentene, 2-methyl-1-butene, 3-methyl-1-butene, 2-methyl-2-butene, 1-hexene, tetramethylethylene, 1-heptene, 1-octene, 1-nonene, 1-decene, etc.;

diolefins—allene, methylallene, butadiene, pentadiene, hexadiene, cyclopentadiene, etc.; and triolefins—ocimene, allo-ocimene, myrcene, hexatriene, etc.

Examples of the acetylene series hydrocarbons applicable in this respect are:

acetylene, methylacetylene, 1-butyne, 2-butyne, 1-pentyne, 1-hexyne, 1-heptyne, 1-octyne, 1-nonyne, and 1-decyne.

Examples of the alicyclic hydrocarbons applicable in this respect are:

cycloparaffins—cyclopropane, cyclobutane, cyclopentane, cyclohexane, cycloheptane, cyclooctane, cyclononane, cyclodecane, cycloundecane, cyclododecane, cyclotridecane, cyclotetradecane, cyclopentadecane, cyclohexadecane, etc.;

cycloolefins—cyclopropene, cyclobutene, cyclopentene, cyclohexene, cycloheptene, cyclooctene, cyclononene, cyclodecene, etc.;

terpenes—limonene, terpinolene, phellandrene, silvestrene, thujene, caren, pinene, bornylene, camphene, fenchene, cyclofenchene, tricyclene, bisabolene, zingiberene, curcumene, humulene, cadine-sesquibenihen, selinene, caryophyllene, santalene, cedrene, camphorene, phyllocladene, podocarprene, mirene, etc.; and steroids.

Examples of the aromatic hydrocarbons applicable in this respect are:

benzene, toluene, xylene, hemimellitene, pseudocumene, mesitylene, prehnitene, isodurene, durene, pentamethyl benzene, hexamethyl benzene, ethylbenzene, propyl benzene, cumene, styrene, biphenyl, terphenyl, diphenylmethane, triphenylmethane, dibenzyl, stilbene, indene, naphthalene, tetralin, anthracene, and phenanthrene.

The carrier gases suitable in the practice of the invention are $H_2$, Ar, Ne, He, etc.

In the practice of the invention, the a-C organic polymer layer is most preferably produced by a plasma process by means of a direct current, high frequency waves, microwaves, etc., but it may be produced by an ionization process, such as a technique of ionized vapor deposition or that of ion-beam vapor deposition, or by a process wherein the formation is from neutral particles, such as a technique of vacuum deposition or that of sputtering, or by a combination of some of these techniques. It is economical to produce the charge generating layer by a method similar to that for the a-C layer from the viewpoint of the cost of the production equipment and saving on the processes.

The charge generating layer of a photosensitive member according to the invention is not restricted to any particular materials; the layer may be produced by, for example, amorphous silicon (a-Si) (which may contain various hetero elements, e.g., H, C, 0, S, N, P, B, a halogen, and Ge to change the property, and also may be a multilayer), Se, Se-As, Se-Te, CdS, or a resin containing inorganic substances such as a copper phthalocyanine and zinc oxide and/or organic substances such as a bisazo pigment, triallylmethane dye, thiazine dye, oxazine dye, xanthene dye, cyanine colorant, styryl colorant, pyrilium dye, azo pigment, quinacridone pigment, indigo pigment, perylene pigment, polycyclic quinone pigment, bis-benzimidazole pigment, indanthrone pigment, squalelum pigment, and phthlocyanine pigment.

Besides the examples mentioned above, the charge generating layer may be of any material that is capable of absorbing light and generating a charge carrier with a very high efficiency.

A charge generating layer according to the invention can be formed at any position in a photosensitive member, that is, for example, it can be formed at any of the top-most, intermediate and lowest layers. The thickness of the layer must in general be set such that a light of 550 nm can be absorbed 90% or more, though depended on the kind of the material used, especially its spectral absorption characteristic, light source for exposure, purpose, etc. With a-Si as the material the thickness must be within the range of 0.1–3 microns.

To adjust the charging property of an a-C charge transporting layer in the invention, heteroatoms, other than carbon and hydrogen, can be incorporated into the material constituting said a-C charge transporting layer. For example, to promote the transporting characteristic of the hole, atoms in Group III in the periodic table or halogen atoms can be incorporated. To promote the transporting characteristic of the electron, atoms in Group V in the periodic table or alkali metal atoms can be incorporated. To promote the transporting characteristic of both positive and negative carriers, atoms of Si, Ge, an alkali earth metal, or an chalcogen can be incorporated. These additive atoms can be used in a plurality of kinds together, at some specific positions in a charge transporting layer according to the purpose, can have a density gradient, or in some other specific manner.

FIGS. 1 through 12 illustrate embodiments of the present invention, each in schematic sectional representation of models, wherein (1) denotes a substrate, (2) an a-C layer as a charge transporting layer, and (3) a charge generating layer. When a photosensitive member of the model shown in FIG. 1 is positively charged and then exposed to image light, a charge carrier is generated in the charge generating layer (3) and the electron neutralizes the surface charge while the positive hole is transported to the substrate (1) under guarantee of a good charge-transporting characteristic of the a-C layer (2). When the photosensitive member shown in FIG. 1 is negatively charged, contrarily the electron is transported through the a-C layer (2).

Figure 2:
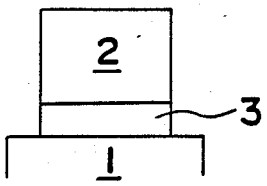

The photosensitive member illustrated in FIG. 2 is an example wherein an a-C layer (2) forms the topmost layer. When it is positively charged, the electron is transported through the a-C layer (2) and, when negatively charged, the hole is transported through the à-C layer (2).

Figure 3:
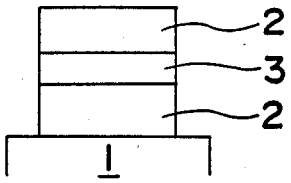

FIG. 3 illustrates a photosensitive member wherein the lower side of the charge generating layer (3). When it is positively charged, the electron is transported through the upper a-C layer (2) and the positive hole is transported through the lower a-C layer (2), and, when negatively charged, the positive hole is transported through the upper a-C layer (2) and the electron through the lower a-C layer (2).

Figure 4:
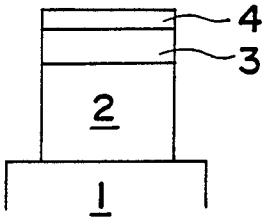
Figure 5:
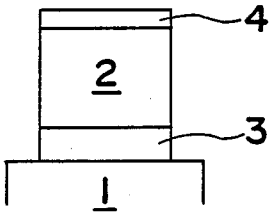
Figure 6:
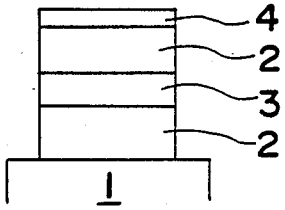

FIGS. 4 through 6 illustrate the same photosensitive members as FIGS. 1 through 3, except that each additionally has a surface-protective overcoat (4) with thickness in the range of 0.01–5 microns, which, in keeping with the operating manner of the respective photosensitive member and the environment where it is used, is designed to protect the charge generating layer (3) or the charge transporting a-C layer (2) and to improve the initial surface potential as well. Any suitable material in public knowledge can be used to make the surface protective layers. It is desirable, in the practice of this invention, to make them by a technique of organic plasma polymerization from the viewpoint of manufacturing efficiency, etc. An a-C layer embodying the invention can also be used for this purpose. Heteroatoms, when required, can be incorporated into the protective layer (4).

Figure 7:
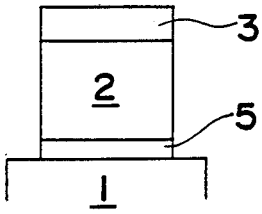
Figure 8:
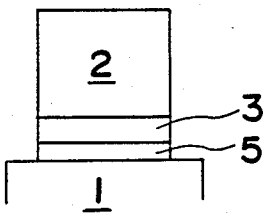
Figure 9:
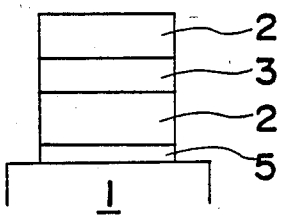
Figure 10:
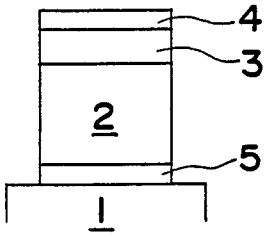
Figure 11:
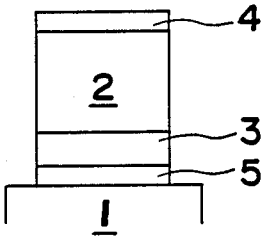
Figure 12:
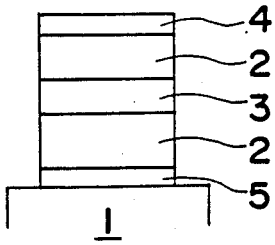

FIGS. 7 through 9 illustrate the same photosensitive members as FIGS. 1 through 3, except that each additionally has an undercoat (5) with a thickness in the range of 0.01–5 microns which functions as an adhesion layer or a barrier layer. Depending on the substrate (1) or the process which it undergoes, this undercoat helps adhesion and prevents injection. Any suitable material in public knowledge can be used to make the undercoat. In this case, too, it is desirable to make them by a technique of organic plasma polymerization. An a-C layer according to the present invention can also be used for the purpose. The photosensitive members shown by FIGS. 7 through 9 can also be provided with an overcoat (4) as illustrated by FIGS. 4 through 6 (see FIGS. 10 through 12).

A photosensitive member of the present invention has a charge generating layer and a charge transporting layer. Therefore the production requires at the least two processes. When, for example, an a-Si layer produced by equipment for glow discharge decomposition is used as the charge generating layer, the same vacuum equipment can be used for plasma polymerization, and it is naturally preferable in such cases to produce the a-C charge transporting layer, the surface-protective layer, the barrier layer, etc., by plasma polymerization.

It is preferable, in the present invention, that the charge transporting layer of the photosensitive member is produced by the so-called plasma-polymerizing reaction, that is, for example:

molecules in the vapor phase undergo discharge decomposition under reduced pressure and produce a plasma atmosphere, from which active neutral seeds or charged seeds are collected on the substrate by diffusing, electrical or magnetic guiding, etc. and deposited as a solid on the substrate through recombination reaction.

Figure 13:
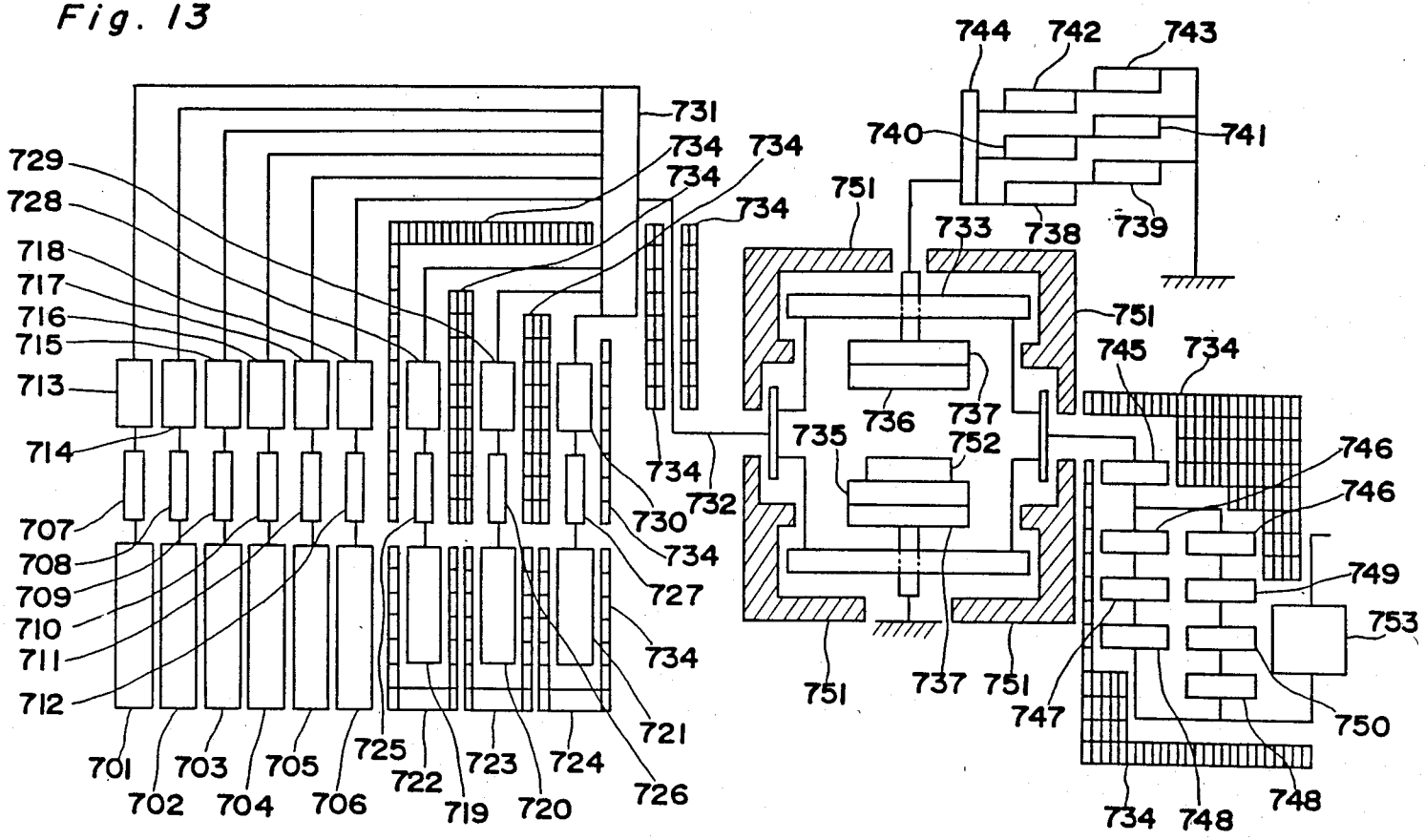
FIGS. 13 and 14 illustrate examples of equipment for fabricating photosensitive members embodying the invention.
Figure 14:
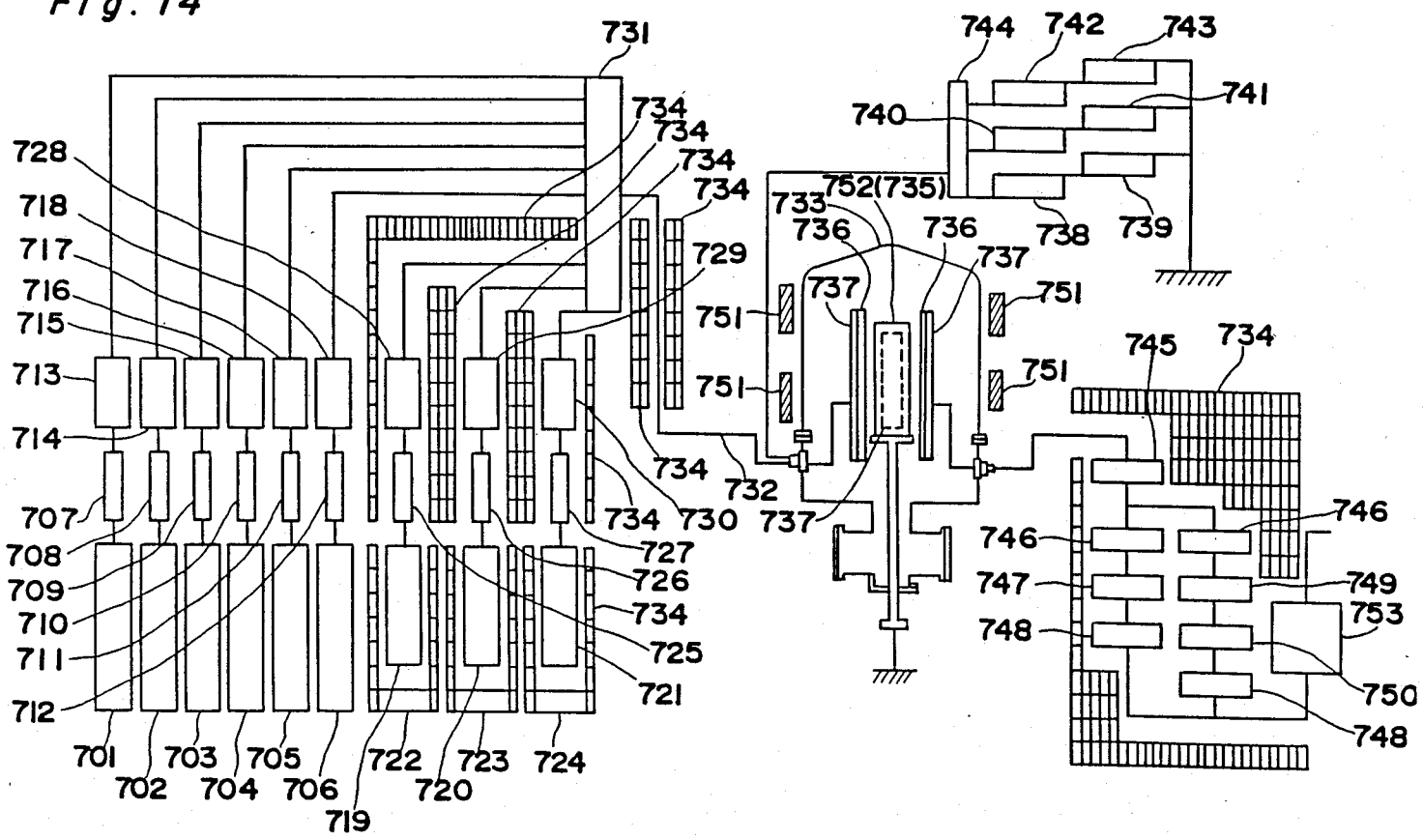

FIGS. 13 and 14 illustrate plasma CVD equipment of the capacitive coupling type for producing photosensitive members of the invention, FIG. 13 representing one of the parallel plate type and FIG. 14 one of the cylindrical type.

In FIG. 13, the numerals (701)–(706) denote No. 1 tank through No. 6 tank which are filled with a feedstock —a compound in the vapor phase at normal temperatures —and a carrier gas, each tank connected with one of six regulating valves—No. 1 through No. 6 (707)–(712)—regulating and one of six flow controllers—No. 1 through No. 6 (713)–(718).

(719)–(721) show vessels No. 1 through No. 3, which contain raw materials that are compounds either in the liquid phase or in the solid phase at normal temperatures, each vessel being capable of being heated for vaporization by means of one of three heaters No. 1 through No. 3 (722)–(724). Each vessel is connected with one of three regulating valves No. 7 through No. 9 (725)–(727) and also with one of three flow controllers No. 7 through No. 9 (728)–(730).

These gases are mixed in a mixer (731) and sent through a main pipe (732) into a reactor (733). The piping is equipped at intervals with pipe heaters (734) so that the gases that are vaporized forms of the feedstock compounds in the liquid or solid state at normal temperatures are prevented from condensing or congealing in the pipes.

In the reaction chamber, there are a grounding electrode(735) and a power-applying electrode (736) installed oppositely, each electrode with a heater (737) for heating the electrode.

Said power-applying electrode is connected to a high frequency power source (739)with a matching box (738) for high frequency power interposed in the connection circuit, to a low frequency power source (741) likewise with a matching box (740) for low frequency power, and to a direct current power source (743) with a low-pass filter (742) interposed in the connection circuit, so that by a connection-selecting switch (744) the mechanism permits application of electric power with a different frequency.

The pressure in the reaction chamber can be adjusted by a pressure control valve (745), and the reduction of the pressure in the reaction chamber can be carried out through an exhaust system selecting valve (746) and by operating a diffusion pump (747) and an oil-sealed rotary vacuum pump (748) in combination or by operating a cooling-elimination device (749), a mechanical booster pump (750) and an oil-sealed rotary vacuum pump in combination.

The exhaust gas is discharged into the ambient air after conversion to a safe unharmful gas by a proper elimination device (753).

The piping in the exhaust system, too, is equipped with pipe heaters at intervals in the pipe lines so that the gases which are vaporized forms of feedstock compounds in the liquid or solid state at normal temperatures are prevented from condensing or congealing in the pipes.

For the same reason the reaction chamber, too, is equipped with a heater (751) for heating the chamber, and an electrode therein are provided with a conductive substrate (752) for the purpose.

FIG. 13 illustrates a conductive substrate (752) fixed to a grounding electrode (735), but it may be fixed to the power-applying electrode (736) and to both the electrodes as well.

The equipment in FIG. 14 is the same in principle as FIG. 13, alterations inside the reaction chamber (733) made in accordance with the cylindrical shape of the conductive substrate (752) being shown in FIG. 14. Said conductive substrate serves as grounding electrode (735) as well, and both the power-applying electrode (736) and the heater (737) for electrode are made in a cylindrical shape.

With a structural mechanism set up as above the pressure in the reaction chamber is reduced preliminarily to a level approximately in the range of $10^{-4}$ to $10^{-6}$ by means of the diffusion pump (747), and then check the degree of vacuum and the gas absorbed inside the equipment is removed by the set procedure. Simultaneously, by the heater (737) for electrode, the electrode (736) and the conductive substrate (752) fixed to the opposing electrode are heated to a specified temperature.

Then, from six tanks, No. 1 through No. 6 (701)–(706), and from three vessels, No. 1 through No. 3 (719)–(721), gases of the raw materials are led into the reaction chamber (733) by regulating the gas flows at constant rates using the nine flow controllers, No. 1 through No. 9 (713)–(718), (728)–(730) and simultaneously the pressure in the reaction chamber (733) is reduced constantly to a specified level by means of a pressure regulating valve.

After the gas flows have stabilized, the connection-selecting switch (744) is put in position for, for example, the high frequency power source (739) so that high frequency power is supplied to the power-applying electrode (736). Then an electrical discharge begins between the two electrodes and an a-C layer in the solid state is formed on the conductive substrate (752) with time.

The ratio of ($\alpha_1/\alpha_2$) and ($\alpha_3/\alpha_4$) can be controlled, being dependent upon the conditions of the production, such as electric power, electric power frequency, space between the electrodes, pressure, temperature of the substrate, kinds of the gases used as feedstock, concentrations of such gases, and flow rates of such gases. For example, the number of the methyl group and the ratio ($\alpha_3/\alpha_4$) can be decreased and the ratio ($\alpha_1/\alpha_2$) can be increased by raising the electric power; likewise, such control of the methyl group is possible by, for example, narrowing the electrode spacing, raising the temperature of the substrate, raising the pressure, lowering the molecular weight of a feedstock gas, and increasing the flow of a gas. It is also possible to bring about a similar effect by superposed application of bias voltages in the range of 50 V–1 KV supplied from the direct current power source (743). The effect is reversed if such conditions of the production are adjusted in reverse. Such changes in the conditions of production can be made in a plurality of ways as methods for imparting additional properties, for example, good hardness, translucency, etc. to the charge transporting layer produced or for ensuring stability of the production process.

A photosensitive member using an organic plasma-polymerized layer of amorphous material produced according to the present invention as the charge-transporting layer exhibits good properties with respect to chargeability and transportation of electric charge, bearing a sufficient surface potential for small thickness of the layer and producing satisfactory images. This invention, when a-Si is used for the charge generating layer, makes it possible to produce a photosensitive member with a thin layer which has not been obtained in any conventional photosensitive member based on a-Si.

Though the main application of the a-C layer is to a charge transporting layer as aforementioned, the a-C layer of the present invention may be used for an overcoat layer having a charge transportability. Even in the case that the a-C layer of the present invention is applied to an overcoat layer above, an excellent durability, of course, can be achieved without increase of residual potential.

According to the present inventions, the production cost of a photosensitive member is lowered and the production time is shortened, because the raw materials cost is low, the formation of the essential layers is carried out in the same chamber, and the layers can be formed in small thickness. According to the present invention, the layer thickness can easily be reduced, because pin holes are hardly formed even in the organic plasma-polymerized layer with a small thickness and the layer is formed with uniformity. Furthermore, this layer can be used as a surface-protective layer to improve the durability of a photosensitive member, because the layer has good properties with respect to resistances to acids, moisture and heat, corona resistance, and stiffness.

This invention will now be explained with reference to examples hereunder.

EXAMPLE 1

(I) Formation of an a-C Layer:

In a system of glow discharge decomposition with equipment as illustrated in FIG. 13, first the reaction chamber (733) was vacuumized inside to a high level of approximately $10^{-6}$ Torr, and then by opening No. 1 and No. 2 regulating valves (707) and (708), $C_2H_4$ gas from No. 1 tank (701) and $H_2$ gas from No. 2 tank (702) were led, under output pressure gage reading of 1 Kg/cm$^2$, into mass flow controllers (713) and (714). Then, the mass flow controllers were set so as to make $C_2H_4$ flow at 30 sccm and $H_2$ flow at 40 sccm, and the gases were allowed into the reaction chamber (733). After the respective flows had stabilized, the internal pressure of the reaction chamber (733) was adjusted to 0.5 Torr. On the other hand, the electrically conductive substrate (752), which was an aluminum plate of $3\times50\times50$ mm, was preliminarily heated up to 250° C., and while the gas flows and the internal pressure were stabilized, it was connected to the high frequency power source (739) and 100 watts power (frequency: 13.56 MHz) was applied to the power-applying electrode (736). After plasma polymerization for approximately four hours, there was formed a charge transporting layer with a thickness of approximately 7 microns on the conductive substrate (752).

Figure 15:
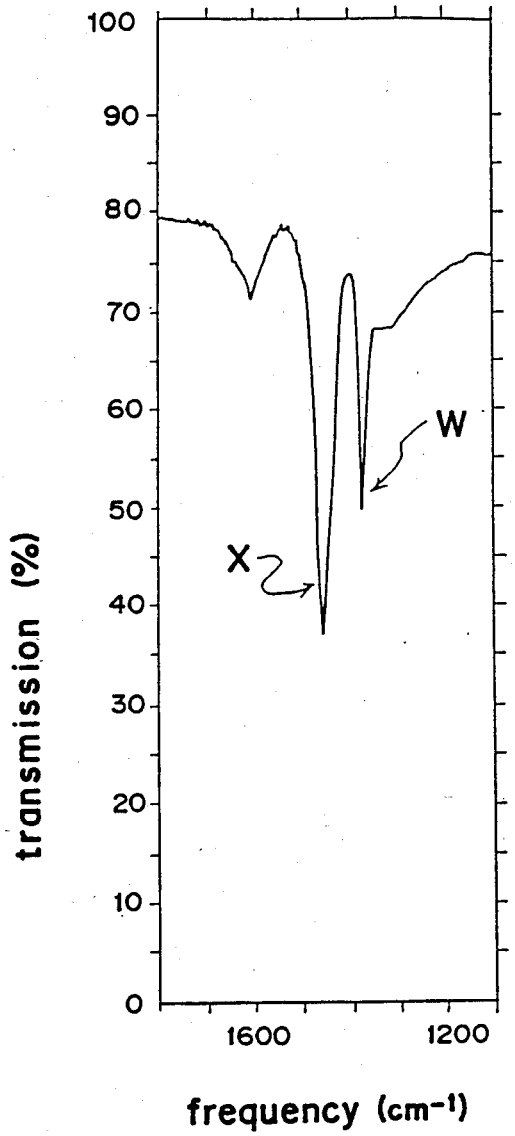
FIGS. 15 and 16 show an infrared absorption spectrum relating to an a-C layer.
Figure 16:
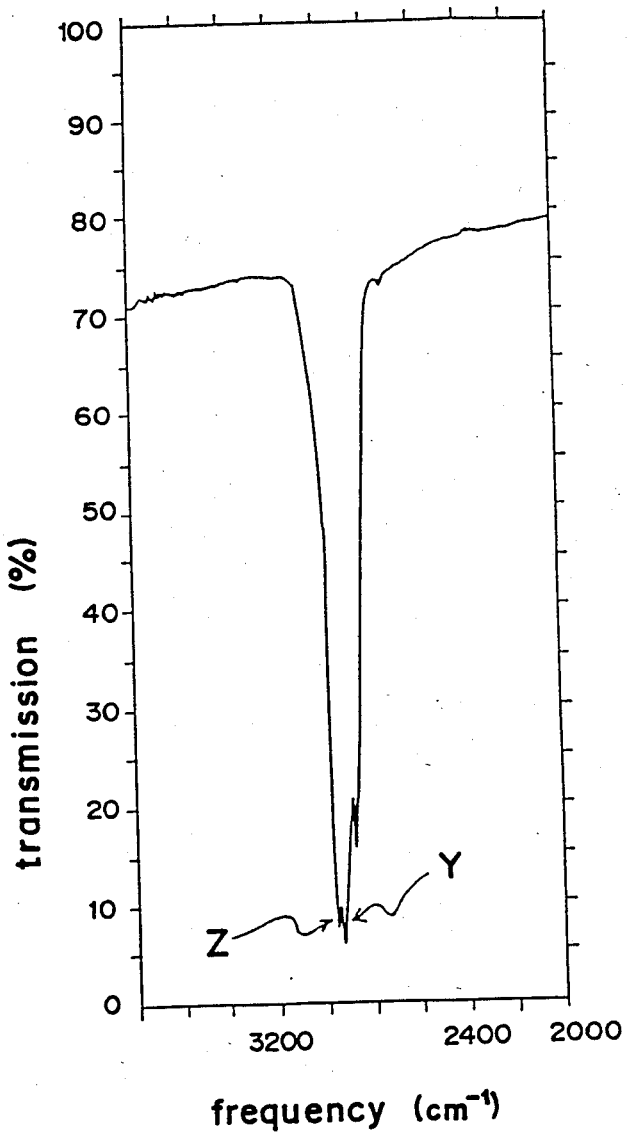

FIG. 15 is a spectral chart obtained by testing the a-C layer formed as above with Fourier transform infrared absorption spectroscope (made by Perkin Elmer). In the test, the a-C layer was laid on KBr and measured at a resolution of 2 cm$^{-1}$. In FIGS. 15 and 16, (w), (x), (y) and (z) show the transmittance peaks of 1380 cm$^{-1}$, 1460 cm$^{-1}$, 2925 cm$^{-1}$, and 2960 cm$^{-1}$ respectively. As the result of the calculation based on the peak of the transmittance and the aforementioned equation the ratio ($\alpha_1$(at 1460 cm$^{-1}$)/$\alpha_2$(at 1380 cm$^{-1}$)) was 1.41, and the ratio ($\alpha_3$(at 2960 cm$^{-1}$)/$\alpha_4$(at 2925 cm$^{-1}$)) was 0.92.

(II) Formation of a charge generating layer:

The power application from the high frequency power source (739) was stopped for a time and the reaction chamber was vacuumized inside.

By opening No. 4 and No. 2 regulating valves (710) and (708), $SiH_4$ gas from No. 4 tank (704) and H2 gas from No. 2 tank (702) were, under output pressure gage reading of 1 Kg/cm$^2$, led into the mass flow controllers (716) and (714). Then, the mass flow controllers were set so as to make $SiH_4$ flow at 90 sccm and $H_2$ flow at 210 sccm, and the gases were allowed into the reaction chamber. After the respective flows had stabilized, the internal pressure of the reaction chamber (733) was adjusted to 1.0 Torr.

While the gas flows and the internal pressure were stabilized, the circuit to the high frequency power source (739) was supplied and a 150 W power (frequency: 13.56 MHz) was applied to the power-applying electrode (736) to generate glow discharge. After 40 minutes of glow discharge, there was formed an a-Si:H charge generating layer with a thickness of 1 micron.

The photosensitive member thus obtained showed a half-reduced exposure value $E_{\frac{1}{2}}$ of 0.25 lux.sec for the initial surface potential (Vo) = −300 volt. This photosensitive member, tested for the image transfer, produced clear images.

EXAMPLE 2

(I) Formation of an a-C Layer:

In a system of glow discharge decomposition with equipment as illustrated in FIG. 14, first the reaction chamber (733) was vacuumized inside to a high level of approximately $10^{-6}$ Torr, and then by opening No. 1 and No. 2 regulating valves (707) and (708), $C_2H_2$ gas from No. 1 tank (701) and $H_2$ gas from No. 2 tank (702) were led, under output pressure gage reading of 1 Kg/cm$^2$, into mass flow controllers (713) and (714). Then, the mass flow controllers were set so as to make $C_2H_2$ flow at 90 sccm and $H_2$ flow at 120 sccm, and the gases were allowed into the reaction chamber (733). After the respective flows had stabilized, the internal pressure of the reaction chamber (733) was adjusted to 1.0 Torr. On the other hand, the electrically conductive substrate (752), which was a cylindrical aluminum substrate of 60 mm (diameter) × 280 mm (length), was preliminarily heated up to 200° C., and while the gas flows and the internal pressure were stabilized, it was connected to the high frequency power source (739) and 100 watts power (frequency: 13.56 MHz) was applied to the power-applying electrode (736). After plasma polymerization for approximately 7 hours, there was formed a charge transporting layer with a thickness of approximately 10 microns on the conductive substrate (752).

The ratio ($\alpha_1$(1460)/$\alpha_2$(1380)) was 2.5 and the ratio ($\alpha_3$ (2960)/$\alpha_4$(2925)) was 0.80.

(II) Formation of a charge generating layer:

The power application from the high frequency power source (739) was stopped for a time and the reaction chamber was vacuumized inside.

By opening No. 4 and No. 2 regulating valves (710) and (708), $SiH_4$ gas from No. 4 tank (704) and $H_2$ gas from No. 2 tank (702) were, under output pressure gage reading of 1 Kg/cm$^2$, led into the mass flow controllers (716) and (714). Then, the mass flow controllers were set so as to make $SiH_4$ flow at 90 sccm and $H_2$ flow at 400 sccm, and the gases were allowed into the reaction chamber. After the respective flows had stabilized, the internal pressure of the reaction chamber (733) was adjusted to 1.0 Torr.

While the gas flows and the internal pressure were stabilized, the circuit to the high frequency power source (739) was supplied and a 150 W power (frequency: 13.56 MHz) was applied to the power-applying electrode (736) to generate glow discharge. After 40 minutes of glow discharge, there was formed an a-Si:H charge generating layer with a thickness of 1 micron.

The photosensitive member thus obtained showed a half-reduced exposure value $E_{\frac{1}{2}}$ of 0.31 lux.sec for the initial surface potential (Vo) = −600 volt. This photosensitive member, tested for the image transfer, produced clear images.

EXAMPLE 3

(I) Formation of an a-C Layer:

In a system of glow discharge decomposition with equipment as illustrated in FIG. 14, first the reaction chamber (733) was vacuumized inside to a high level of approximately $10^{-6}$ Torr, and then by opening No. 1–No. 3 regulating valves (707)–(709), $C_2H_4$ gas from No. 1 tank (701), $CH_4$ gas from No. 2 tank (702) and $H_2$ gas from No. 3 tank (703) were led, under output pressure gage reading of 1 Kg/cm$^2$, into mass flow controllers (713)–(715). Then, the mass flow controllers were set so as to make $C_2H_4$ flow at 55 sccm, $CH_4$ flow at 60 sccm, and $H_2$ flow at 100 sccm, and the gases were allowed into the reaction chamber (733). After the respective flows had stabilized, the internal pressure of the reaction chamber (733) was adjusted to 0.2 Torr. On the other hand, the electrically conductive substrate (752), which was an cylindrical aluminum substrate of 80 mm (diameter) × 320 mm (length), was preliminarily heated up to 250° C., and while the gas flows and the internal pressure were stabilized, it was connected to the high frequency power source (739) and 200 watts power (frequency: 13.56 MHz) was applied to the power-applying electrode (736). After plasma polymerization for approximately 3 hours, there was formed a charge transporting layer with a thickness of approximately 5 microns on the conductive substrate (752).

The ratio ($\alpha_1$(1460)/$\alpha_2$(1380)) was 1.15, and the ratio ($\alpha_3$(2960)/$\alpha_4$(2925)) was 1.02.

(II) Formation of a charge generating layer:

The power application from the high frequency power source (739) was stopped for a time and the reaction chamber was vacuumized inside.

By opening No. 4 and No. 3 regulating valves (710) and (709), $SiH_4$ gas from No. 4 tank (704) and $H_2$ gas from No. 3 tank (703) were, under output pressure gage reading of 1 Kg/cm$^2$, led into the mass flow controllers (716) and (715). Then, the mass flow controllers were set so as to make $SiH_4$ flow at 90 sccm and $H_2$ flow at 400 sccm, and the gases were allowed into the reaction chamber. In the similar manner $B_2H_6$ gas that was diluted to a concentration of 50 ppm was flowed at 10 sccm through No. 5 tank (705). After the respective flows had stabilized, the internal pressure of the reaction chamber (733) was adjusted to 1.0 Torr.

While the gas flows and the internal pressure were stabilized, the circuit to the high frequency power source (739) was supplied and a 150 W power (frequency: 13.56 MHz) was applied to the power-applying electrode (736) to generate glow discharge. After 40 minutes of glow discharge, there was formed an a-Si:H charge generating layer with a thickness of 1 micron.

The photosensitive member thus obtained showed a half-reduced exposure value $E_{\frac{1}{2}}$ of 0.25 lux.sec for the initial surface potential (Vo) = +450 volt. This photosensitive member, tested for the image transfer, produced clear images.

EXAMPLE 4

(I) Formation of an a-C Layer:

In a system of glow discharge decomposition with equipment as illustrated in FIG. 13, first the reaction chamber (733) was vacuumized inside to a high level of approximately $10^{-6}$ Torr, and then by opening No. 6 and No. 7 regulating valves (712) and (725), He gas from No. 6 tank (706) under output pressure gage reading of 1 Kg/cm$^2$, and stylene gas from No. 1 vessel (719) that was heated at about 50° C. by No. 1 heater (722) were led into mass flow controllers (718) and (728). Then, the mass flow controllers were set so as to make He flow at 30 sccm and stylene flow at 18 sccm, and the gases were allowed into the reaction chamber (733). After the respective flows had stabilized, the internal pressure of the reaction chamber (733) was adjusted to 0.5 Torr. On the other hand, the electrically conductive substrate (752), which was an aluminum plate of 3 ×50×50 mm, was preliminarily heated up to 50° C., and while the gas flows and the internal pressure were stabilized, it was connected to the low frequency power source (736) and 150 watts power (frequency: 30 KHz) was applied to the power-applying electrode (736). After plasma polymerization for approximately 40 minutes, there was formed a charge transporting layer with a thickness of approximately 5 microns on the conductive substrate (752).

The ratio ($\alpha_1(1460)/\alpha_2(1380)$) was 1.95, and the ratio ($\alpha_3(2960)/\alpha_4(2925)$) was 0.85.

(II) Formation of a charge generating layer:

The power application from the low frequency power source (741) was stopped for a time and the reaction chamber was vacuumized inside.

By opening No. 4 and No. 3 regulating valves (710) and (709), $SiH_4$ gas from No. 4 tank (704) and $H_2$ gas from No. 3 tank (703) were, under output pressure gage reading of 1 Kg/cm$^2$, led into the mass flow controllers (716) and (715). Then, the mass flow controllers were set so as to make $SiH_4$ flow at 90 sccm and $H_2$ flow at 210 sccm, and the gases were allowed into the reaction chamber. After the respective flows had stabilized, the internal pressure of the reaction chamber (733) was adjusted to 1.0 Torr.

While the gas flows and the internal pressure were stabilized, the circuit to the high frequency power source (739) was supplied and a 150 W power (frequency: 13.56 MHz) was applied to the power-applying electrode (736) to generate glow discharge. After 40 minutes of glow discharge, there was formed an a-Si:H charge generating layer with a thickness of 1 micron.

The photosensitive member thus obtained showed a half-reduced exposure value $E_{\frac{1}{2}}$ of 0.39 lux.sec for the initial surface potential (Vo)=−500 volt. This photosensitive member, tested for the image transfer, produced clear images.

EXAMPLE 5

(I) Formation of an a-C Layer:

In a system of glow discharge decomposition with equipment as illustrated in FIG. 14, first the reaction chamber (733) was vacuumized inside to a high level of approximately $10^{-6}$ Torr, and then by opening No. 1–No. 3 regulating valves (707)–(709), $C_2H_4$ gas from No. 1 tank (701) butadiene gas from No. 2 tank (702) and $H_2$ gas from No. 3 tank (703) were led, under output pressure gage reading of 1 Kg/cm$^2$, into mass flow controllers (713)–(715). Then, the mass flow controllers were set so as to make $C_2H_4$ flow at 55 sccm, butadiene flows at 55 sccm and $H_2$ flow at 100 sccm, and the gases were allowed into the reaction chamber (733). After the respective flows had stabilized, the internal pressure of the reaction chamber (733) was adjusted to 1.5 Torr. On the other hand, the electrically conductive substrate (752), which was a cylindrical aluminum substrate of 80 mm (diameter)×320 mm (length), was preliminarily heated up to 50° C., and while the gas flows and the internal pressure were stabilized, it was connected to the high frequency power source (739) and 200 watts power (frequency: 13.56 MHz) was applied to the power-applying electrode (736). After plasma polymerization for approximately 12 hours, there was formed a charge transporting layer with a thickness of approximately 5 microns on the conductive substrate (752).

The ratio ($\alpha_1(1460)/\alpha_2(1380)$) was 0.9, and the ratio ($\alpha_3(2960)/\alpha_4(2925)$) was 1.2.

(II) Formation of a charge generating layer:

The power application from the high frequency power source (739) was stopped for a time and the reaction chamber was vacuumized inside.

By opening No. 4 and No. 3 regulating valves (710) and (709), $SiH_4$ gas from No. 4 tank (704) and $H_2$ gas from No. 3 tank (703) were, under output pressure gage reading of 1 Kg/cm$^2$, led into the mass flow controllers (716) and (715). Then, the mass flow controllers were set so as to make $SiH_4$ flow at 90 sccm and $H_2$ flow at 300 sccm, and the gases were allowed into the reaction chamber. After the respective flows had stabilized, the internal pressure of the reaction chamber (733) was adjusted to 1.0 Torr.

While the gas flows and the internal pressure were stabilized, the circuit to the high frequency power source (739) was supplied and a 150 W power (frequency: 13.56 MHz) was applied to the cylindrical electrode (752) to generate glow discharge. After 40 minutes of glow discharge, there was formed an a-Si:H charge generating layer with a thickness of 1 micron.

The photosensitive member thus obtained showed a half-reduced exposure value $E_{\frac{1}{2}}$ of 0.30 lux.sec for the initial surface potential (Vo)=−600 volt. This photosensitive member, tested for the image transfer, produced clear images.

EXAMPLE 6

(I) Formation of an a-C Layer:

In a system of glow discharge decomposition with equipment as illustrated in FIG. 13, first the reaction chamber (733) was vacuumized inside to a high level of approximately $10^{-6}$ Torr, and then by opening No. 1 and No. 2 regulating valves (707) and (708), $C_2H_4$ gas from No. 1 tank (701) and H2 gas from No. 2 tank (702) were led, under output pressure gage reading of 1 Kg/cm$^2$, into mass flow controllers (713) and (714). Then, the mass flow controllers were set so as to make $C_2H_4$ flow at 180 sccm and $H_2$ flow at 240 sccm, and the gases were allowed into the reaction chamber (733). After the respective flows had stabilized, the internal pressure of the reaction chamber (733) was adjusted to 0.5 Torr. On the other hand, the electrically conductive substrate (752), which was an aluminum plate of 3×50×50 mm, was preliminarily heated up to 250° C., and while the gas flows and the internal pressure were stabilized, it was connected to the high frequency power source (739) and 500 watts power (frequency: 13.56 MHz) was applied to the power-applying electrode (736). After plasma polymerization for approximately 6 hours, there was formed a charge transporting layer with a thickness of approximately 18 microns on the conductive substrate (752).

The ratio ($\alpha_1(1460)/\alpha_2(1380)$) was 3.5, and the ratio ($\alpha_3(2960)/\alpha_4(2925)$ was 0.70.

(II) Formation of a charge generating layer:

The power application from the high frequency power source (739) was stopped and the reaction chamber was vacuumized inside. Then, the chamber was leaked and the obtained material was taken out.

Using other vacuum vapor deposition device, $As_2Se_3$ was deposited on the charge transporting layer produced by the process (I) by resistance heater method to form a layer of about 3 microns meter.

The photosensitive member thus obtained showed a half-reduced exposure value $E_{\frac{1}{2}}$ of 1.5 lux.sec for the initial surface potential (Vo)=+600 volt. This photosensitive member had a practicable sensitivity, though the sensitivity was less than those of Examples 1–5, and tested for the image transfer, produced clear images.

EXAMPLE 7

(I) Formation of an a-C Layer:

In a system of glow discharge decomposition with equipment as illustrated in FIG. 14, first the reaction chamber (733) was vacuumized inside to a high level of approximately $10^{-6}$ Torr, and then by opening No. 1–No. 3 regulating valves (707)–(709), $C_2H_6$ gas from No. 1 tank (701), $C_3H_8$ gas from No.2 tank (702) and $H_2$ gas from No. 3 tank (703) were led, under output pressure gage reading of 1 Kg/cm$^2$, into mass flow controllers (713) - (715). Then, the mass flow controllers were set so as to make $C_2H_6$ flow at 30 sccm, $C_3H_8$ flow at 30 sccm and $H_2$ flow at 100 sccm, and the gases were allowed into the reaction chamber (733). After the respective flows had stabilized, the internal pressure of the reaction chamber (733) was adjusted to 0.8 Torr. On the other hand, the electrically conductive substrate (752), which was cylindrical aluminum substrate of 80 mm (diameter) ×320 mm (length), was preliminarily heated up to 60° C., and while the gas flows and the internal pressure were stabilized, it was connected to the high frequency power source (739) and 200 watts power (frequency: 13.56 MHz) was applied to the power-applying electrode (736). After plasma polymerization for approximately 15 hours, there was formed a charge transporting layer with a thickness of approximately 20 microns on the conductive substrate (752).

The ratio ($\alpha_1(1460)/\alpha_2(1380)$) was 0.7, and the ratio ($\alpha_3(2960)/\alpha_4(2952)$) was 1.30.

(II) Formation of a charge generating layer:

The power application from the high frequency power source (739) was stopped for a time and the reaction chamber was vacuumized inside.

By opening No. 4 and No. 3 regulating valves (710) and (709), $SiH_4$ gas from No. 4 tank (704) and $H_2$ gas from No. 3 tank (703) were, under output pressure gage reading of 1 Kg/cm$^2$, led into the mass flow controllers (716) and (715). Then, the mass flow controllers were set so as to make $SiH_4$ flow at 100 scmm and $H_2$ flow at 400 sccm, and the gases were allowed into the reaction chamber. After the respective flows had stabilized, the internal pressure of the reaction chamber (733) was adjusted to 0.8 Torr.

While the gas flows and the internal pressure were stabilized, the circuit to the high frequency power source (739) was supplied and a 150 W power (frequency: 13.56 MHz) was applied to the power-applying electrode (736) to generate glow discharge. After 35 minutes of glow discharge, there was formed an a-Si:H charge generating layer with a thickness of 1 micron.

The photosensitive member thus obtained showed a half-reduced exposure value $E_{\frac{1}{2}}$ of 0.52 lux.sec for the initial surface potential (Vo)=−400 volt. This photosensitive member had a practicable sensitivity, though the sensitivity was lower than those of Examples 1–6, and tested for the image transfer, produced clear images.

EXAMPLE 8

(I) Formation of an a-C Layer:

In a system of glow discharge decomposition with equipment as illustrated in FIG. 13, first the reaction chamber (733) was vacuumized inside to a high level of approximately $10^{-6}$ Torr, and then by opening No. 1 and No. 7 regulating valves (707) and (725), $H_2$ gas from No. 1 tank (701) and $C_6H_{14}$ gas from No. 1 vessel (719) were led, under output pressure gage reading of 1 Kg/cm$^2$, into mass flow controllers (713) and (728). Then, the mass flow controllers were set so as to make $H_2$ flow at 300 sccm and $C_6H_{14}$ flow at 30 sccm, and the gases were allowed into the reaction chamber (733). After the respective flows had stabilized, the internal pressure of the reaction chamber (733) was adjusted to 0.3 Torr. On the other hand, the electrically conductive substrate (752), which was an aluminum plate of 3×50×50 mm, was preliminarily heated up to 30° C., and while the gas flows and the internal pressure were stabilized, it was connected to the high frequency power source (739) and 50 watts power (frequency: 13.56 MHz) was applied to the power-applying electrode (736). After plasma polymerization for approximately 6 hours, there was formed a charge transporting layer with a thickness of approximately 18 microns on the conductive substrate (752).

The ratio ($\alpha_1(1460)/\alpha_2(1380)$) was 0.5, and the ratio ($\alpha_3(2960)/\alpha_4(2925)$) was 1.5.

(II) Formation of a charge generating layer:

The power application from the high frequency power source (739) was stopped for a time and the reaction chamber was vacuumized inside.

By opening No. 4 and No. 3 regulating valves (710) and (709), $SiH_4$ gas from No. 4 tank (704) and $H_2$ gas from No. 3 tank (703) were, under output pressure gage reading of 1 Kg/cm$^2$, led into the mass flow controllers (716) and (715). Then, the mass flow controllers were set so as to make $SiH_4$ flow at 90 sccm and $H_2$ flow at 180 sccm, and the gases were allowed into the reaction chamber. In a similar manner $B_2H_6$ gas which was diluted to the concentration of 50 ppm with $H_2$ gas was flowed at 10 sccm from No. 5 tank (705). After the respective flows had stabilized, the internal pressure of the reaction chamber (733) was adjusted to 1.0 Torr.

While the gas flows and the internal pressure were stabilized, the circuit to the high frequency power source (739) was supplied and a 170 W power (frequency: 13.56 MHz) was applied to the power-applying electrode (736) to generate glow discharge. After 30 minutes of glow discharge, there was formed an a-Si:H charge generating layer with a thickness of 1 micron.

The photosensitive member thus obtained showed a half-reduced exposure value $E_{\frac{1}{2}}$ of 0.49 lux.sec for the initial surface potential (Vo)=+350 volt. This photosensitive member had a practicable sensitivity, though the sensitivity was lower than those of Examples 1–6, and tested for the image transfer, produced clear images.

EXAMPLE 9

(I) Formation of an a-C Layer:

In a system of glow discharge decomposition with equipment as illustrated in FIG. 14, first the reaction chamber (733) was vacuumized inside to a high level of approximately $10^{-6}$ Torr, and then by opening No. 1–No. 3 regulating valves (707)–(709), $C_2H_4$ gas from No. 1 tank (701), $CH_4$ gas from No.2 tank (702) and $H_2$ gas from No. 3 tank (703) were led, under output pressure gage reading of 1 Kg/cm$^2$, into mass flow controllers (713)–(715) Then, the mass flow controllers were set so as to make $C_2H_4$ flow at 200 sccm, $CH_4$ flow at 180 sccm, and $H_2$ flow at 100 sccm, and the gases were allowed into the reaction chamber (733). After the respective flows had stabilized, the internal pressure of the reaction chamber (733) was adjusted to 2.0 Torr. On the other hand, the electrically conductive substrate (752), which was a cylindrical aluminum substrate of 80 mm (diameter)×320 mm (length), was preliminarily heated up to 300° C., and while the gas flows and the internal pressure were stabilized, it was connected to the high frequency power source (739) and 300 watts power (frequency: 13.56 MHz) was applied to the power-applying electrode (736). After plasma polymerization for approximately 2 hours, there was formed a charge transporting layer with a thickness of approximately 10 microns on the conductive substrate (752).

The ratio ($\alpha_1(1460)/\alpha_2(1380)$) was 5.0, and the ratio ($\alpha_3(2960)/\alpha_4(2925)$) was 0.5. contained therein.

(II) Formation of a charge generating layer:

The power application from the high frequency power source (739) was stopped for a time and the reaction chamber was vacuumized inside.

By opening No. 4 and No. 3 regulating valves (710) and (709), $SiH_4$ gas from No. 4 tank (704) and $H_2$ gas from No. 3 tank (703) were, under output pressure gage reading of 1 Kg/cm$^2$, led into the mass flow controllers (716) and (715). Then, the mass flow controllers were set so as to make $SiH_4$ flow at 120 sccm and $H_2$ flow at 400 sccm, and the gases were allowed into the reaction chamber. In a similar manner, $B_2H_6$ gas which was diluted to the concentration of 50 ppm with $H_2$ gas was flowed at 12 sccm from No. 5 tank (705). After the respective flows had stabilized, the internal pressure of the reaction chamber (733) was adjusted to 1.0 Torr.

While the gas flows and the internal pressure were stabilized, the circuit to the high frequency power source (739) was supplied and a 200 W power (frequency: 13.56 MHz) was applied to the cylindrical electrode (752) to generate glow discharge. After 30 minutes of glow discharge, there was formed an a-Si:H charge generating layer with a thickness of 1 micron.

The photosensitive member thus obtained showed a half-reduced exposure value $E_{178}$ of 10.3 lux.sec for the initial surface potential (Vo)=+450 volt. This photosensitive member had a practicable sensitivity, though the sensitivity was lower than those of Examples 1–8, and tested for the image transfer, produced clear images.

EXAMPLE 10

A photosensitive member as schematically shown by FIG. 2 was made.

(II) First, the charge generating layer was formed.

In a conventional vacuum vapor deposition device, a vapor deposition layer of titanyl phthalocyanine (TiOPc) was formed. The deposition was continued for approximately four minutes under the conditions: boat temperature 440°-490° C., degree of vacuum $5\times10^{-6}-1\times10^{-5}$ (Torr), and film-forming rate 3 angstrom/sec, and a TiOPc deposition layer with a thickness of 700 angstrom was obtained as a charge generating layer. A cylindrical aluminum electrode of 80 mm in diameter and 320 mm in length was used as the substrate.

(I) The substrate on which the charge generating layer had been formed was brought into a device for glow discharge decomposition schematically shown in FIG. 14 and a charge transporting layer was formed thereon in the same manner as the process (I) in Example 5.

The photosensitive member thus obtained showed a half-reduced exposure value $E_{\frac{1}{2}}$ of 0.48 lux.sec for an initial surface potential (Vo)=−600 V. This photosensitive member, tested for image transfer, produced clear images.

COMPARATIVE EXAMPLE 1

An a-Si:H layer with a thickness of 6 microns was formed by a process identical with the process (II) for a charge generating layer in Example 1 (Process (I) for an a-Si layer was cut out) to obtain an a-Si:H photosensitive member.

The photosensitive member thus obtained showed a half-reduced exposure value $E_{\frac{1}{2}}$ of 0.7 lux.sec for an initial surface potential (Vo)=−100 V. The chargeability was inadequate when the polarity was positive, and the use of this photosensitive member failed to produce satisfactory images.

COMPARATIVE EXAMPLE 2

Instead of the process (I) in Example 1 in the practice of this invention, a polyethylene layer having the ratio $\alpha_1(1460)/\alpha_2(1380)$ of 7.06 was formed as a charge transporting layer by a conventional method of organic polymerization, and a charge generating layer was superimposed thereon by the process (II) in Example 1. The laminated layer obtained thereby differed from embodiments of the invention only in the ratio of the peak absorptivity in the infrared absorption spectrum. The chargeability was the same as in Example 1, but the sensitivity showed a potential attenuation caused by the a-Si layer only to a small degree, not reaching half the value. This comparison attested the advantages of a charge transporting layer embodying the invention.

COMPARATIVE EXAMPLE 3

Instead of the process (I) in Example 1 in the practice of this invention, a polyethylene layer having the ratio $\alpha_3(2960)/\alpha_4(2925)$ of 0.15 was formed as a charge transporting layer by a conventional method of organic polymerization, and a charge generating layer was superimposed thereon by the process (II) in Example 1. The laminated layer obtained thereby differed from embodiments of the invention only in the ratio of the peak absorptivity in the infrared absorption spectrum. The chargeability was the same as in Example 1, but the sensitivity showed a potential attenuation caused by the a-Si layer only to a small degree, not reaching half the value. This comparison attested the advantages of a charge transporting layer embodying the invention.

COMPARATIVE EXAMPLE 4

(I) In a system of glow discharge decomposition with equipment as illustrated in FIG. 14, first the reaction chamber (733) was vacuumized inside to a high level of approximately $10^{-6}$ Torr, and then by opening No. 1 and No. 2 regulating valves (707) and (708), $C_2H_4$ gas from No. 1 tank (701) and $H_2$ gas from No. 2 tank (702) were led, under output pressure gage reading of 1 Kg/cm$^2$, into the mass flow controllers (713) and (714). Then, the mass flow controllers were set so as to make $C_2H_4$ flow at 250 sccm and $H_2$ flow at 350 sccm, and the gases were allowed into the reaction chamber (733). After the respective flows had stabilized, the internal pressure of the reaction chamber (733) was adjusted to 0.5 Torr. On the other hand, the cylindrical electrically conductive substrate (752), cylindrical electrically conductive substrate (752), cylindrical aluminum substrate of 80 mm in diameter and 320 mm in length, was preliminarily heated up to 250°, and while the gas flows and the internal pressure were stabilized, it was connected to the high frequency power source (737) and a 500 watt power (frequency: 13.56 Mhz) was applied to the power applying electrode (736). After plasma polymerization for approximately two hours, there was formed a charge transporting layer with a thickness of approximately 7 microns on the cylindrical conductive substrate (752), wherein the ratio ($\alpha_1(1460)/\alpha_2(1380)$) was 5.52, and the ratio ($\alpha_3(2960)/\alpha_4(2925)$) was 0.45.

(II) The power application from the high frequency power source (739) was stopped for a time and the reaction chamber was vacuumized inside.

By opening No. 4 and No. 3 regulating valves (710) and (709), $SiH_4$ gas from No. 4 tank (704) and $H_2$ gas from No. 3 tank (703) were, under output pressure gage reading of 1 Kg/cm$^2$, led into the mass flow controllers (716) and (715). Then, the mass flow controllers were set so as to make $SiH_4$ flow at 90 sccm and $H_2$ flow at 400 sccm, and the gases were allowed into the reaction chamber. After the respective flows had become stabilized, the internal pressure of the reaction chamber (733) was adjusted to 1 Torr.

While the gas flows and the internal pressure were stabilized, the circuit to the high frequency power source (739) was closed and a 150 W power (frequency: 13.56 Mhz) was applied to the power-applying electrode (736) in a procedure to start glow discharge. After 40 minutes of glow discharge, there was formed an a-Si:H charge generating layer with a thickness of 1 micron.

The photosensitive member thus obtained, in a test by image exposure, did not attain a half-reduced potential for an initial surface potential of (Vo)=−350 volt. It became clear from this result that this photosensitive member could not be employed in electrophotography.

COMPARATIVE EXAMPLE 5

(I) In a system of glow discharge decomposition with equipment as illustrated in FIG. 13, first the reaction chamber (733) was vacuumized inside to a high level of approximately $10^{-6}$ Torr, and then by opening No. 1 and No. 7 valves (707) and (725), $H_2$ gas from No. 1 tank (701) and styrene gas from No. 1 vessel (719) were led into mass flow controllers (713) and (728). No. 1 vessel (719) had been heated up to approximately 50° C. by No. 1 heater (722) when it began to be used for this operation. Then, the mass flow controllers were set so as to make $H_2$ flow at 60 sccm and styrene flow at 60 sccm, and the gases were allowed into the reaction chamber (733). After the respective flows had stabilized, the internal pressure of the reaction chamber (733) was adjusted to 0.8 Torr. On the other hand, the electrically conductive substrate (752), which was an aluminum plate of 3×50×50 mm, was preliminarily heated up to 50° C., and while the gas flows and the internal pressure were stabilized, it was connected to the low frequency power source (741) and a 150 watt power (frequency: 100 KHz) was applied to the power-applying electrode (736) in a procedure to start plasma polymerization. After allowing the plasma polymerization to continue for approximately 50 minutes, there was formed on said conductive substrate (752) a charge transporting layer with a thickness of approx. 10 microns wherein the ratio ($\alpha_1(1460)/\alpha_2(1380)$) was 0.46, and the ratio ($\alpha_3(2960)/\alpha_4(2925)$) was 1.6.

The layer thus produced appeared noticeably rough physically.

(II) The power application from the low frequency power source (741) was stopped for a time and the reaction chamber was vacuumized inside.

By opening No. 4 and No. 3 regulating valves (710) and (709), $SiH_4$ gas from No. 4 tank (704) and $H_2$ gas from No. 3 tank (703) were, under output pressure gage reading of 1 Kg/cm$^2$, led into the mass flow controllers (716) and (715). Then, the mass flow controllers were set so as to make $SiH_4$ flow at 90 sccm and $H_2$ flow at 200 sccm, and the gases were allowed into the reaction chamber. In a similar manner, $B_2H_6$ gas from No. 5 tank (705), diluted in a concentration of 50 ppm with $H_2$ was allowed into the reaction chamber at a flow rate of 10 sccm. After the respective flows had stabilized, the internal pressure of the reaction chamber (733) was adjusted to 1.0 Torr.

While the gas flows and the internal pressure were stabilized, the circuit to the high frequency power source (739) was closed and a 150 W power (frequency: 13.56 MHz) was applied to the power-applying electrode (736) in a procedure to start glow discharge. After 40 minutes of glow discharge, there was formed an a-Si:H charge generating layer with a thickness of 1 micron.

The photosensitive member thus obtained showed an initial surface potential of only (Vo)=+20 volt and some peeling in parts, and it was clear that the product was unsuitable for the use as a photosensitive member.

What is claimed is:

1. A photosensitive member comprising:
an electrically conductive substrate;
a charge generating layer; and
a charge transporting layer for retaining and transporting charges, said charge transporting layer having a thickness of from about 5 to about 50 microns and comprising a plasma-polymerized layer of an amorphous material formed by organic plasma polymerization and comprising hydrogen and carbon, wherein the infrared absorption spectrum of said plasma-polymerized layer has a ratio ($\alpha_1/\alpha^2$) of from 0.5 to 5.0, wherein $\alpha^1$ is a coefficient of peak absorptivity attributed to methyl group (—$CH_3$) and/or methylene group (—$CH_2$—) at least 1460 cm$^{-1}$ and about 1470 cm$^{-1}$ and $\alpha_2$ is a coefficient of peak absorptivity attributed to methyl group (—$CH_3$) at about 1380 cm$^{-1}$.

2. A photosensitive member as claimed in claim 1 wherein the ratio of $\alpha_1/\alpha_2$ is preferably 0.9 to 2.5.

3. A photosensitive member comprising:
an electrically conductive substrate;
a charge generating layer; and
a plasma-polymerized layer of an amorphous material comprising hydrogen and carbon, being formed by organic plasma polymerization and having a thickness of from about 5 to about 50 microns, wherein the infrared absorption spectrum of said plasma-polymerized layer has a ratio ($\alpha_1/\alpha_2$) of from 0.5 to 5.0, wherein $\alpha_1$ is a coefficient of peak absorptivity attributed to methyl group (—$CH_3$) and/or methylene group (—$CH_2$—) at about 1460 cm$^{-1}$ and about 1470 cm$^{-1}$ and $\alpha_2$ is a coefficient of peak absorptivity attributed to methyl group (—$CH_3$) at about 1380 cm$^{-1}$.

4. A photosensitive member as claimed in claim 3 wherein the ratio of $\alpha_1/\alpha_2$ is preferably 0.9 to 2.5.

5. A photosensitive member as claimed in claim 3 wherein said plasma-polymerized layer functions to retain and transport charges.

6. A photosensitive member comprising:

an electrically conductive substrate;

a charge generating layer; and a charge transporting layer for retaining and transporting charges, said charge transporting layer having a thickness of from about 5 to about 50 microns and comprising a plasma-polymerized layer of an amorphous material formed by organic plasma polymerization and comprising hydrogen and carbon, wherein the infrared absorption spectrum of said plasma-polymerized layer has a ratio ($\alpha_3/\alpha_4$) of from 0.5 to 1.5, wherein $\alpha_3$ is a coefficient of peak absorptivity attributed to methyl group ($—CH_3$) at about 2960 $cm^{-1}$, and $\alpha_4$ is a coefficient of peak absorptivity attributed to methylene group ($—CH_2—$) at about 2925 $cm^{-1}$.

7. A photosensitive member as claimed in claim 6 wherein the ratio of $\alpha_3/\alpha_4$ is preferably 0.8 to 1.2.

8. A photosensitive member as claimed in claim 6 wherein said carbon atoms preferably constitute methyl group in a ratio of 28 to 52% based on the amount of all carbon atoms.

9. A photosensitive member comprising:

an electrically conductive substrate;

a charge generating layer; and a plasma-polymerized layer of an amorphous material comprising hydrogen and carbon and having a thickness of from about 5 to about 50 microns, said plasma-polymerized layer of an amorphous material being formed by organic plasma polymerization, wherein the infrared absorption spectrum of said plasma-polymerized layer has a ratio ($\alpha_3/\alpha_4$) of from 0.5 to 1.5, wherein $\alpha_3$ is a coefficient of peak absorptivity attributed to methyl group ($—CH_3$) at about $cm^{-1}$, and $\alpha_4$ is a coefficient of peak absorptivity attributed to methylene group ($—CH_2$) at about 2925 $cm^{-1}$.

10. A photosensitive member as claimed in claim 9 wherein the ratio of $\alpha_3/\alpha_4$ is preferably 0.8 to 1.2.

11. A photosensitive member as claimed in claim 9 wherein said plasma-polymerized layer functions to retain and transport charges.

* * * * *